US006787101B1

(12) United States Patent
Däcker et al.

(10) Patent No.: US 6,787,101 B1
(45) Date of Patent: Sep. 7, 2004

(54) DIE-CASTING BRASS ALLOY WHICH IS RESISTANT TO DEZINCIFICATION

(75) Inventors: Carl-Åke Däcker, Skövde (SE); Ulla Langelotz, Fristad (SE)

(73) Assignee: Tour & Andersson AB, Ljung (SE)

( * ) Notice: Subject to any disclaimer, the term of this patent is extended or adjusted under 35 U.S.C. 154(b) by 67 days.

(21) Appl. No.: 10/069,467

(22) PCT Filed: Aug. 18, 2000

(86) PCT No.: PCT/SE00/01589

§ 371 (c)(1),
(2), (4) Date: Feb. 21, 2002

(87) PCT Pub. No.: WO01/14606

PCT Pub. Date: Mar. 1, 2001

(30) Foreign Application Priority Data

Aug. 26, 1999 (SE) ..... 9903003

(51) Int. Cl.[7] ..... C22C 9/01

(52) U.S. Cl. ..... 420/479; 148/434

(58) Field of Search ..... 420/479, 478; 148/434

(56) References Cited

FOREIGN PATENT DOCUMENTS

| | | | | |
|---|---|---|---|---|
| EP | 0 572 959 A1 | | 5/1993 | ..... C22C/9/04 |
| JP | 58181839 | | 10/1983 | ..... C22C/9/04 |
| JP | 59118842 | | 7/1984 | ..... C22C/9/04 |
| SE | 358415 | * | 7/1973 | |
| WO | 89/08725 | | 9/1989 | ..... C22C/9/04 |

OTHER PUBLICATIONS

Hansen, "Constitution of binary alloys", New York, 1958. (To follow).

Louvo, Amo, Rapio Rantala, Veijo Tauta, "The Effect of Composition on as–cast Microstructure of alfa/beta–Brass and its Control by Microcomputer", LISBOA 84, 51 st International Foundry Congress. (To follow).

*MNC Handbook*, vol., No. 8, Sep. 1987, Metallnormcentralen, "Koppar och koppartegeringar", "specialmässing sidan 43". (To follow).

* cited by examiner

*Primary Examiner*—Sikyin Ip
(74) *Attorney, Agent, or Firm*—Davis & Bujold PLLC

(57) ABSTRACT

The present invention relates to a die-casting brass alloy having a dezincification resistance, which is lower than 100 μm for a separate value according to British Standard BS 2872 in a die-casting condition (i.e. without a subsequent phase transforming heat treatment). The alloy according to the invention is characterized by the following composition:

| | |
|---|---|
| Cu: | 63.6 weight-% |
| Pb: | 1.8 weight-% |
| Si: | 0.73 weight-% |
| Al: | 0.07 weight-% |
| As: | 0.06 weight-% |
| Ni: | 0.2 weight-% |
| Sn: | 0.3 weight-% |
| Fe: | 0.25 weight-% |
| B: | 8 ppm |
| Other impurities: | max. 0.3 weight-% |
| Zn: | remainder. |

2 Claims, 6 Drawing Sheets

Hot-learing tendencies and the binary copper-zinc phase diagram

The result of the dezincification tests.

DIE-CASTING BRASS ALLOY WHICH IS RESISTANT TO DEZINCIFICATION

FIELD OF THE INVENTION

The present invention relates to a die-casting brass alloy, which is resistant to dezincification.

BACKGROUND OF THE INVENTION

Dezincification is a problem for brass water fittings, when the water quality varies and maybe is strongly corrosive.

It is known, that it is possible to treat the copper rich alpha-phase in brass against dezincification by means of small additions of arsenic or antimony, whereas the zinc rich beta-phase is not resistant to dezincification.

Thus, it would be logical to keep a high percentage of copper in a brass alloy resistant to dezincification (as an alloy 1 in FIG. 1, showing a portion of the phase diagram Cu—Zn, Hansen, Constitution of binary alloys, New York 1958) in order to minimize or completely avoid the amount of the less corrosive resistant beta-phase. The problem with such an alloy is, that it results in a primary solidification of the alpha-phase in the form of long solidification crystals, so called dendrites, which means, that the beta-phase will form long bands between the alpha-dendrites. This results in two negative consequences:

a) The material will be brittle by heat; and b) The material will obtain a deep dezincification, since the dezincification will follow the long beta-phase bands.

This phenomenon is thoroughly described in the following scientific article: Arno Louvo, Tapio Rantala, Veijo Tauta, "The Effect of Composition on as-cast Microstructure of alfa/beta-Brass and its Control by Microcomputer", LISBOA 84, 51 st International Foundry Congress.

FIG. 2, which has been excerpted from this article, describes the problem with brittleness by heat, and FIG. 3, which has been excerpted from the same article, the phenomenon with increasing dezincification depths with an increasing copper content.

In order to avoid the above-mentioned problems the alloy must solidify primarily in the beta-phase as an alloy 2 in FIG. 1, which allows the following advantages:

a) The amounts of micro and macro segregations will be substantially lower for an alloy, which solidifies primarily in the beta-phase. This is caused by the fact, that the diffusion speed in the beta-phase is about 1000 times higher than in the alpha-phase, which is a result of the fact, that its crystal structure has an atom arrangement according to bcc (body-centered-cubic) as compared to the atom arrangement of the alpha-phase fcc (face-centered-cubic).

b) The solidification crystals may be fine grain-treated with boron, which forms fine grains in a very efficient way, and only extremely small amounts of this substance is needed to obtain a fine grain-forming effect. According to experience boron does not have a fine grain-forming effect on brass, which solidifies primarily in the alpha-phase, whereas it is very efficient as far as nucleation of beta-crystals is concerned.

The drawback is, that the beta-phase amount increases in the final casting structure and without a heat treatment it will be difficult to meet the toughest dezincification requirements, which requires a maximal dezincification depth of 100 $\mu$m as a separate value. This is true above all for heavy thicknesses of material, shown in FIG. 3.

The information above are known basic facts.

Additional already known techniques are described in WO 89/08725 A1, EP 0 572 959 A1 and MNC manual no. 8, edition 2, September 1987, "Specialmässing", page 43.

The object of the present invention is to suggest a way of eliminating the above-mentioned drawbacks.

SUMMARY OF THE INVENTION

This object is attained according to the invention by the development of an alloy having the following characteristics.

By balancing copper, zinc, silicon and aluminum in a capable manner it is possible to attain a solidification in the beta-phase and nevertheless avoid the development of continuous beta-phase areas in the finished product. The beta-phase will be found in isolated agglomerates in a matrix of alpha-phase, which is protected against a dezincification due to the arsenic addition. The primary solidification in the beta-phase with the alloy combination according to the invention combined with the high solidification speed of the die-casting limits the size of the agglomerates of the beta-phase in the final casting structure, the agglomerates also in a thick diecasting material with a low solidification speed obtaining an extension, which is clearly less than 100 $\mu$m. By means of fine grain-treatment with boron the size of the agglomerates and consequently also the depth of the dezincification can be additionally reduced.

BRIEF DESCRIPTION OF THE DRAWINGS

The invention will now be described, by way of example, with reference to the accompanying drawings in which.

DETAILED DESCRIPTION OF THE INVENTION

These conclusions have been confirmed by the results of an extensive development effort during several years, the purpose of which has been to find appropriate alloy combinations.

Figure 1:
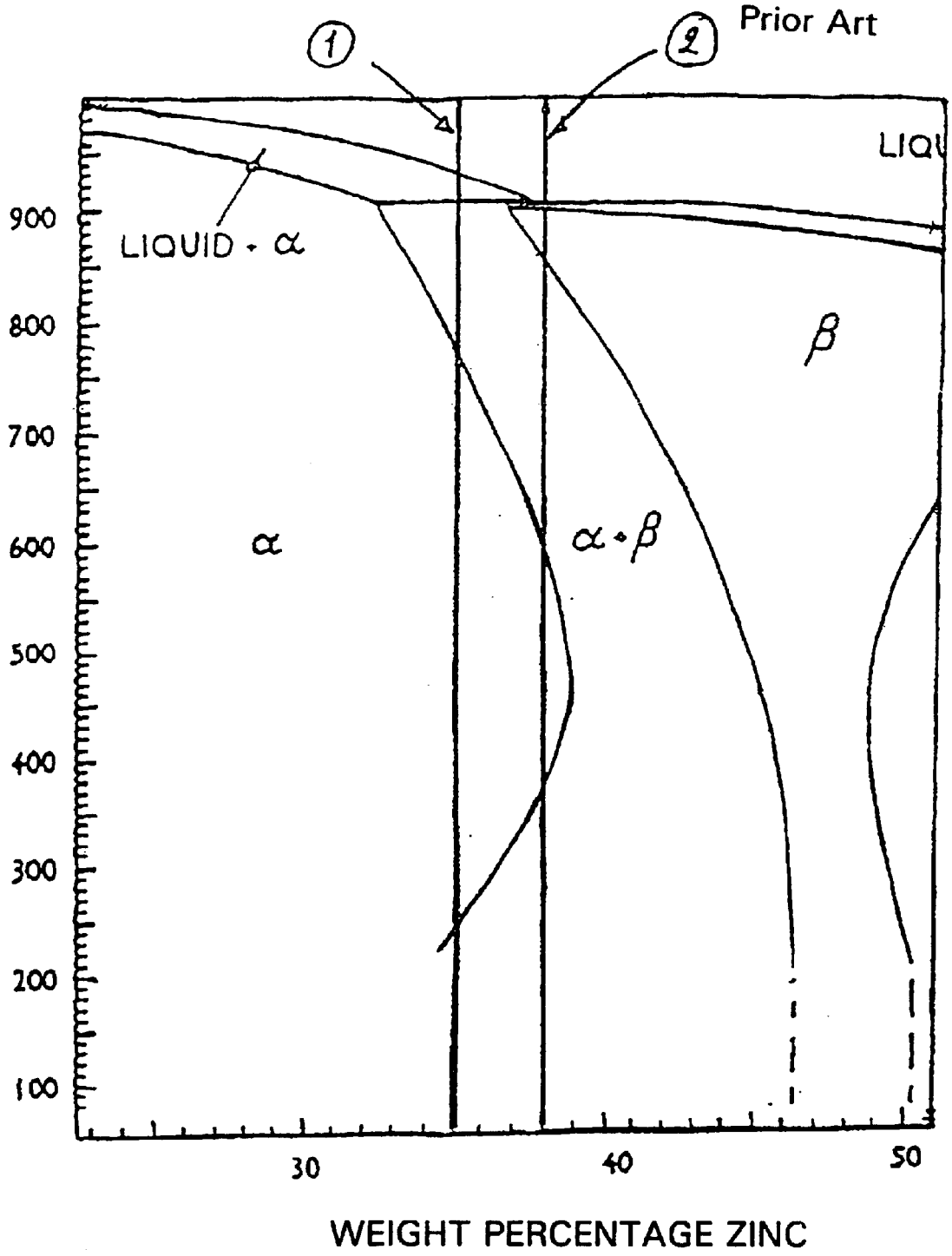
Fig. 1 Prior Art
FIG. 1 shows a portion of a phase diagram Cu—Zn.
Figure 2:
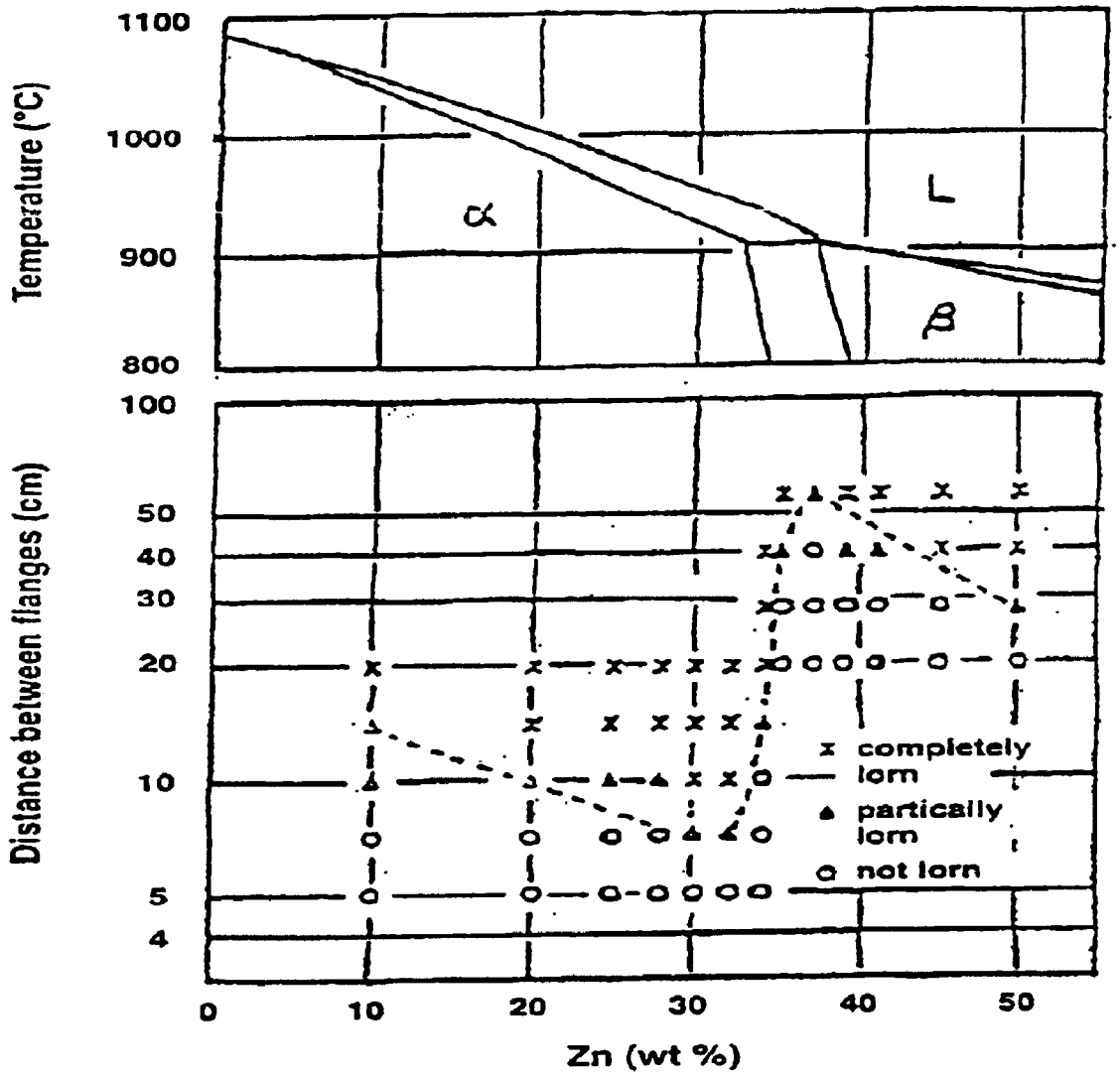
Fig. 2 Prior Art
FIG. 2 describes a problem with brittleness by heat.
Figure 3:
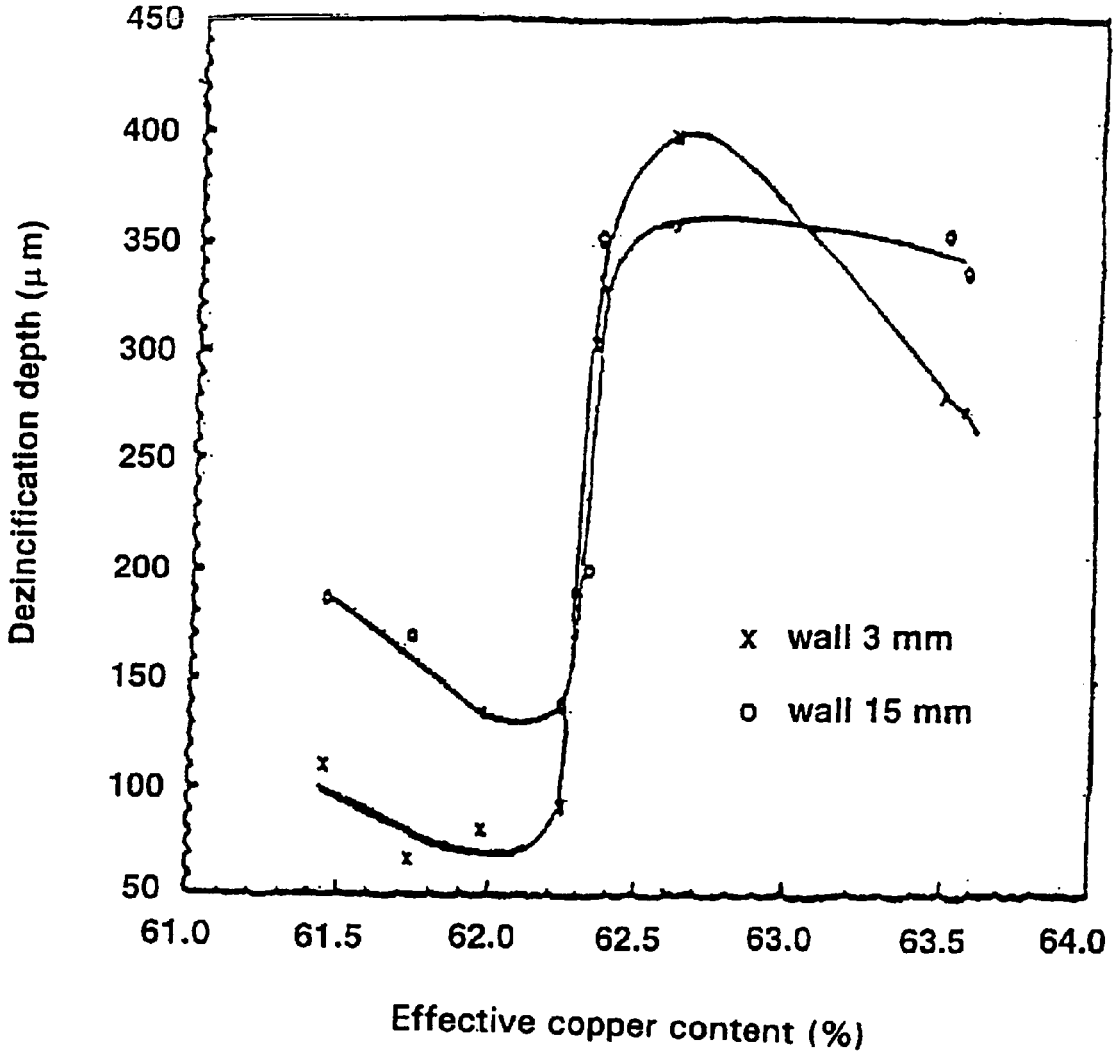
Fig. 3 Prior Art
FIG. 3 shows a phenomenon with increasing dezincification depths with an increasing copper content.
Figure 4:
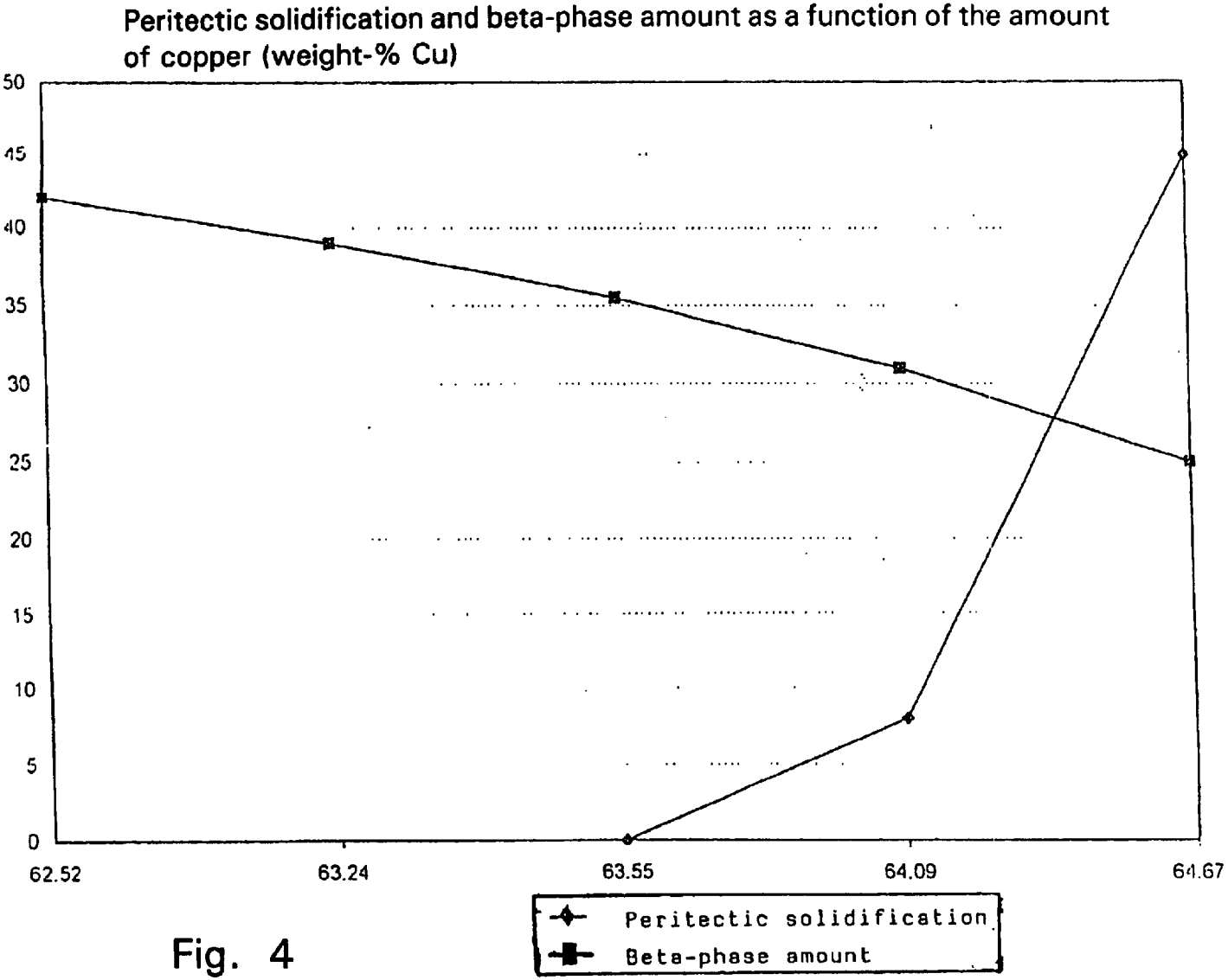
FIG. 4 shows how the amount of peritecticly solidifying materials (solidification primarily in the alpha-phase) quickly is reduced, when the copper content in the alloy is reduced, whereas the increase of the amount in the beta-phase in the final structure increases relatively slowly.

FIG. 4 shows how the amount of peritecticly solidifying materials (solidification primarily in the alpha-phase) quickly is reduced, when the copper content in the alloy is reduced, whereas the increase of the amount in the beta-phase in the final structure increases relatively slowly.

Figure 5:
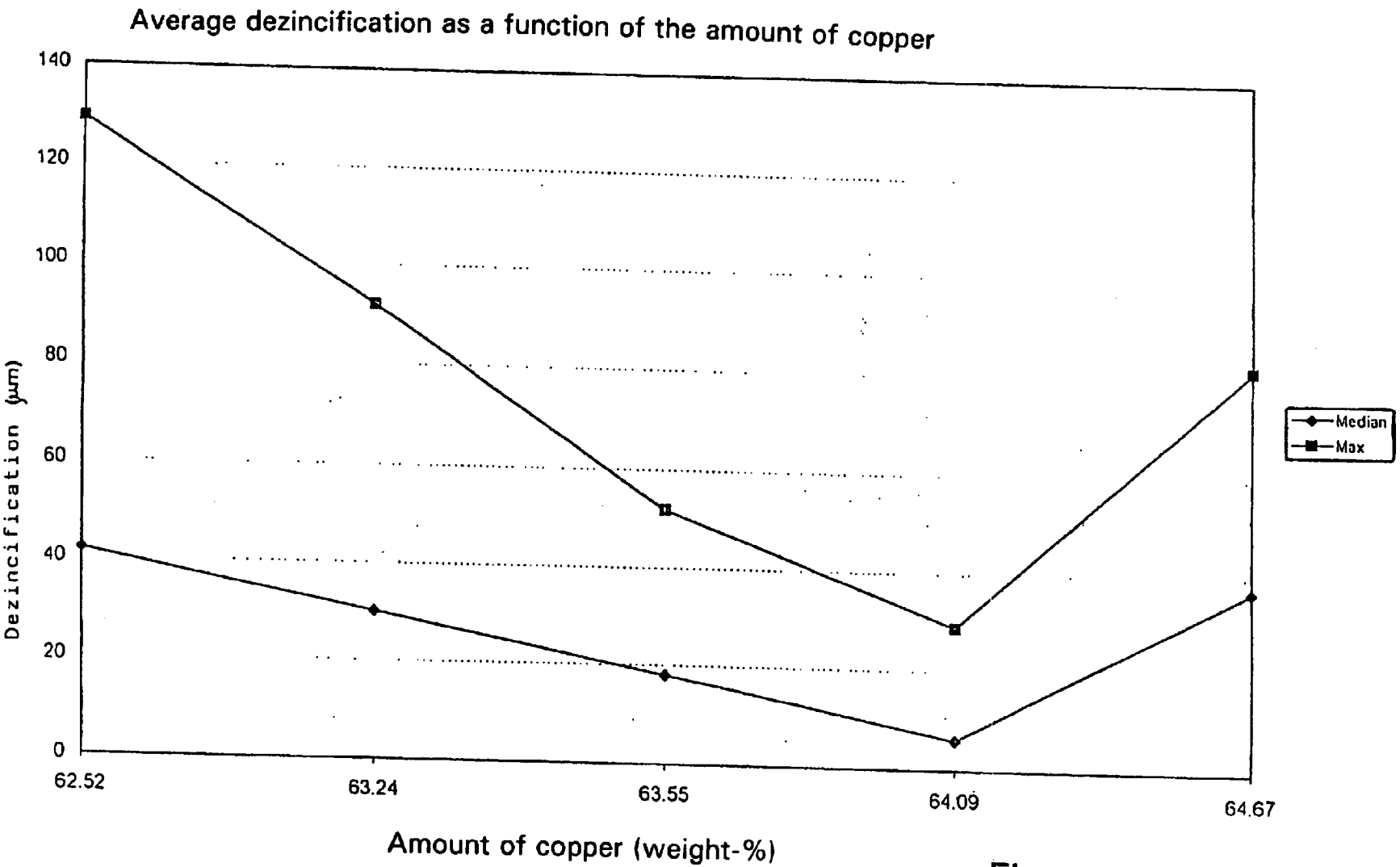
FIG. 5 shows the result from investigations of the dezincification depth according to the international standard ISO 6509 for die-cast work pieces having a 6 mm thickness of material as to alloys having a varying Cu content.

FIG. 5 shows the result from investigations of the dezincification depth according to the international standard ISO 6509 for die-cast work pieces having a 6 mm thickness of material as to alloys having a varying Cu content. The result is unambiguous. A dezincification minimum is attained exactly in the area, where the peritecticly solidification ceases, at the same time as the amount of beta-phase has not yet become too large. The figure shows a dezincification depth for a maximal separate value as well as median values for a number of measurements, done on the same test object. The result is, that in a relatively wide area the obtained result falls below the requirements regarding the dezincification resistance of maximally 100 μm for a separate value.

Figure 6:
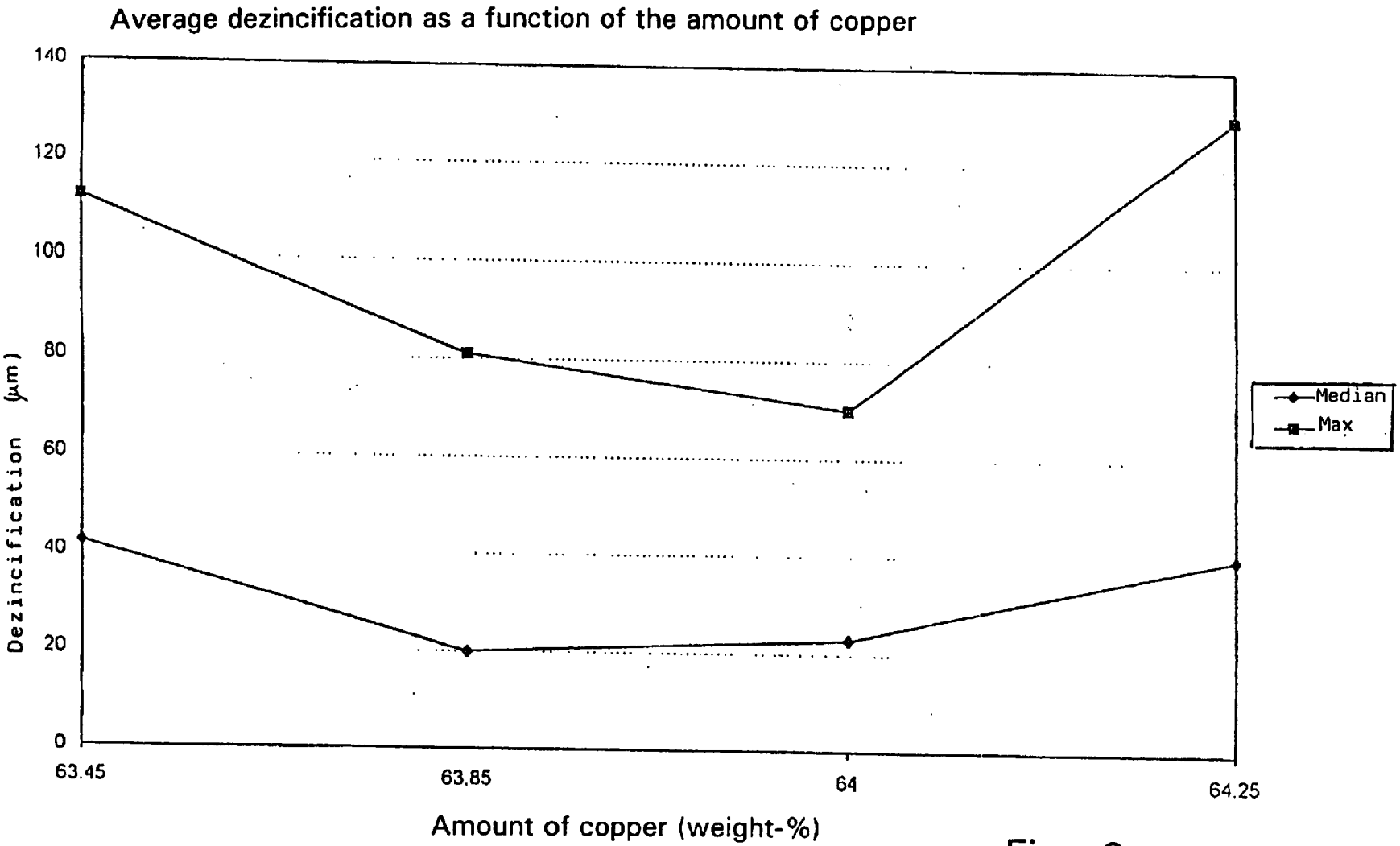
FIG. 6 shows the result for the corresponding investigation with a material thickness of 16 mm.

The object of the invention is to suggest an alloy, which also meets the dezincification requirements for thick die-cast materials, and FIG. 6 shows the result for the corresponding investigation with a material thickness of 16 mm. Also for this material thickness the requirement is met, namely maximally 100 μm for a separate value but within a more narrow interval.

At a Cu content of lower than 63.6% the beta-phase agglomerates become so large, that they start to grow together, which results in a too large dezincification.

At a Cu content of higher than 64.1% the amount of primary solidification in the alpha-phase becomes so large, that long beta-phase bands develop between the alpha crystals and consequently a deep dezincification is obtained.

The positive results of this balancing of the alloy ingredients are summarized as follows:

1) Die-cast material, made of the alloy, meet, without a subsequent heat treatment, the requirements as to a maximal dezincification depth of 100 μm for a separate value 2) The alloy can be fine grain-treated with boron in an efficient way, which results in a most fine-grained structure in the finished product, which results in two advantages:

The dezincification resistance is further improved, because the size of the beta-phase agglomerates is further reduced; and The porosity in the die-cast material is distributed more evenly and the separate size becomes smaller, which reduces the risk of a leaky die-cast material and consequently the rejection costs for products, which must meet pressure impenetrability requirements, are also reduced.

3) The aluminum content can be kept at a low level, 0.03–0.1 weight-%, which means, that the positive effect of the aluminum addition on a die-casting alloy is utilized, but the negative effects are avoided.

Positive effects include the strong dezincification effect of aluminum, which means, that also at a low aluminum content the oxygen content in the melt is stable and very low. Aluminum exerts also in small amounts a purification effect in such a way, that it reduces a zinc oxide coating on pouring cups, molding tools and cores; and Negative effects include the formation in alloys, which include silicon and in which the aluminum content is larger than 0.1 weight-%, of a sticky slag, which consists of aluminum silicates. When a melt is applied with a cup, a portion of this slag will be introduced into the product, in which it forms "hazes" and "balls". These inclusions impair the mechanical properties of the finished product, but, what is worse, they function as capillaries, which means, that the dezincification follows the inclusions, if they reach the surface, which results in deep dezincifications, which by far goes beyond the requirements regarding the dezincification resistance of a maximally 100 μm dezincification for a separate value.

In this respect the present invention differs from the fine grain-treated alloy according to DE-A 43 18 377 A1, which recommends an aluminum content of 0.3–0.7 weight-% and a silicon content of 0.3–0.7 weight-%.

A dezincification resistant alloy according to the present invention is characterized by the following compositions:

| | |
|---|---|
| Cu: | 63.0–65.5 weight-% |
| Pb: | 1.5–2.2 weight-% |
| Si: | 0.6–0.9 weight-% |
| Al: | 0.03–0.1 weight-% |
| As: | 0.03–0.1 weight-% |
| Ni: | max 0.5 weight-% |
| Sn: | max 0.5 weight-% |
| Fe: | 0.1–0.5 weight-% |
| B: | 0–15 ppm |
| Other impurities: | max. 0.3 weight-% |
| Zn: | remainder |

An example of a specified alloy, which has been produced for quite a long time on a large scale, has turned out to meet the requirements according to the invention quite well:

| | |
|---|---|
| Cu: | 63.6 weight-% |
| Pb: | 1.8 weight-% |
| Si: | 0.73 weight-% |
| Al: | 0.07 weight-% |
| As: | 0.06 weight-% |
| Ni: | 0.2 weight-% |
| Sn: | 0.3 weight-% |
| Fe: | 0.25 weight-% |
| B: | 8 ppm |
| Other impurities: | max. 0.3 weight-% |
| Zn: | remainder |

The invention is not limited to the preferred embodiments specified above, but it can be modified and supplemented in an arbitrary fashion within the scope of the inventive idea and the following claims. This is particularly true, as regards the lead content, since lead is not dissolved in the alloy but remains as a separate phase, which does not influence the dezincification resistance. This means, that, if the lead content is reduced to below the specified interval, the rest of the alloy elements must be adjusted stochiometrically.

What is claimed is:

1. A die-casting brass alloy resistant to dezincification, the alloy comprising a composition of:

| | |
|---|---|
| Cu: | 63.6–65.0 weight-% |
| Pb: | 1.8–2.2 weight-% |
| Si: | 0.6–0.9 weight-% |
| Al: | 0.03–0.1 weight-% |
| As: | 0.03–0.1 weight-% |
| Ni: | 0.2–less than 0.5 weight-% |
| Sn: | max 0.5 weight-% |
| Fe: | 0.1–0.5 weight-% |
| B: | 8–less than 15 ppm |
| Other impurities: | max. 0.3 weight-% |
| Zn: | remainder. |

2. A diecasting brass alloy having a dezincification resistance lower than 100 $\mu$m, characterized by the following composition:

| | |
|---|---|
| Cu: | 63.6 weight-% |
| Pb: | 1.8 weight-% |
| Si: | 0.73 weight-% |
| Al: | 0.07 weight-% |
| As: | 0.06 weight-% |
| Ni: | 0.2 weight-% |

-continued

| | |
|---|---|
| Sn: | 0.3 weight-% |
| Fe: | 0.25 weight-% |
| B: | 8 ppm |
| Other impurities: | max. 0.3 weight-% |
| Zn: | remainder. |

* * * * *